US009149867B2

(12) United States Patent
Miyazaki et al.

(10) Patent No.: US 9,149,867 B2
(45) Date of Patent: Oct. 6, 2015

(54) LOW-CARBON STEEL SLAB PRODUCING METHOD

(75) Inventors: Masafumi Miyazaki, Tokyo (JP); Hideaki Yamamura, Tokyo (JP); Satoru Mineta, Tokyo (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 288 days.

(21) Appl. No.: 13/568,200

(22) Filed: Aug. 7, 2012

(65) Prior Publication Data

US 2012/0298320 A1 Nov. 29, 2012

Related U.S. Application Data

(62) Division of application No. 12/989,201, filed as application No. PCT/JP2009/062795 on Jul. 15, 2009, now abandoned.

(30) Foreign Application Priority Data

Jul. 15, 2008 (JP) ..... P2008-183740

(51) Int. Cl.
*B22D 1/00* (2006.01)
*B22D 11/00* (2006.01)
(Continued)

(52) U.S. Cl.
CPC *B22D 1/00* (2013.01); *B22D 11/00* (2013.01); *B22D 11/108* (2013.01); *B22D 11/11* (2013.01); *C21C 7/0006* (2013.01); *C21C 7/06* (2013.01); *C22C 38/005* (2013.01); *C22C 38/14* (2013.01)

(58) Field of Classification Search
None
See application file for complete search history.

(56) References Cited

U.S. PATENT DOCUMENTS 3,871,870 A 3/1975 Nemoto et al.
5,609,199 A * 3/1997 Kato et al. ..... 164/473
(Continued)

FOREIGN PATENT DOCUMENTS

CN 1529762 A 9/2004
CN 100999803 A 7/2007
(Continued)

OTHER PUBLICATIONS

Chinese Office Action, dated Aug. 2, 2012, issued in Chinese Patent Application No. 200980115461.0.
(Continued)

*Primary Examiner* — Kevin P Kerns
*Assistant Examiner* — Jacky Yuen
(74) *Attorney, Agent, or Firm* — Birch, Stewart, Kolasch & Birch, LLP

(57) ABSTRACT

A low-carbon steel slab producing method includes: adding Ti to a molten steel decarbonized to have a carbon concentration of 0.05 mass % or less, and subsequently adding at least one of La and Ce to adjust a constitution, and producing a smelted molten steel; and pouring the smelted molten steel into a casting mold via a tundish; wherein at least one of La and Ce in a total amount of 0.2 to 1.2 times an increased amount of oxygen in the smelted molten steel during contained in the tundish is added to the smelted molten steel in the tundish, so as to obtain a steel slab having inclusions which contain oxides of Ti and at least one of La and Ce as chief components, and so as to make a composition of each of the inclusions have a mass ratio of 0.1 to 0.7, in terms of $(La_2O_3+Ce_2O_3)\div TiO_n$ (n=1~2).

1 Claim, 1 Drawing Sheet

(51) Int. Cl.

| | |
|---|---|
| ***B22D 11/108*** | (2006.01) |
| ***B22D 11/11*** | (2006.01) |
| ***C21C 7/06*** | (2006.01) |
| ***C21C 7/00*** | (2006.01) |
| ***C22C 38/00*** | (2006.01) |
| ***C22C 38/14*** | (2006.01) |

(56) References Cited

U.S. PATENT DOCUMENTS

| | | | | |
|---|---|---|---|---|
| 6,117,389 | A * | 9/2000 | Nabeshima et al. | 420/83 |
| 2004/0168749 | A1 * | 9/2004 | Sasai et al. | 148/320 |
| 2006/0260719 | A1 | 11/2006 | Mizoguchi et al. | |

FOREIGN PATENT DOCUMENTS

| | | | | |
|---|---|---|---|---|
| CN | 101016603 | A | | 8/2007 |
| CN | 101020942 | A | | 8/2007 |
| CN | 101078091 | A | | 11/2007 |
| JP | 62-227565 | A | | 10/1987 |
| JP | 62227565 | A | * | 10/1987 |
| JP | 63-149057 | A | | 6/1988 |
| JP | 5-104219 | A | | 4/1993 |
| JP | 5-302112 | A | | 11/1993 |
| JP | 08332551 | A | * | 12/1996 |
| JP | 9-3597 | A | | 1/1997 |
| JP | 9-47854 | A | | 2/1997 |
| JP | 9-300051 | A | | 11/1997 |
| JP | 2002-88412 | A | | 3/2002 |
| JP | 2002088412 | A | * | 3/2002 |
| JP | 2004-143510 | A | | 5/2004 |
| JP | 2005-248313 | A | | 9/2005 |
| JP | 2005248313 | A | * | 9/2005 |
| JP | 2006-225727 | A | | 8/2006 |
| JP | 2007-239062 | A | | 9/2007 |
| JP | 2007-254819 | A | | 10/2007 |
| JP | 2007254819 | A | * | 10/2007 |
| WO | 03/002771 | A1 | | 1/2003 |

OTHER PUBLICATIONS

Corrected Version of the International Search Report, dated Oct. 6, 2009, for Application No. PCT/JP2009/062795 (Corrected Version dated Nov. 6, 2009).

International Search Report, dated Oct. 6, 2009 and issued in PCT/JP2009/062795.

Japanese Office Action, dated Sep. 15, 2009, for Japanese Application No. 2008-183740.

U.S. Office Action, dated May 8, 2012, issued in copending U.S. Appl. No. 12/989,201.

U.S. Office Action, dated Sep. 7, 2011, issued in copending U.S. Appl. No. 12/989,201.

* cited by examiner

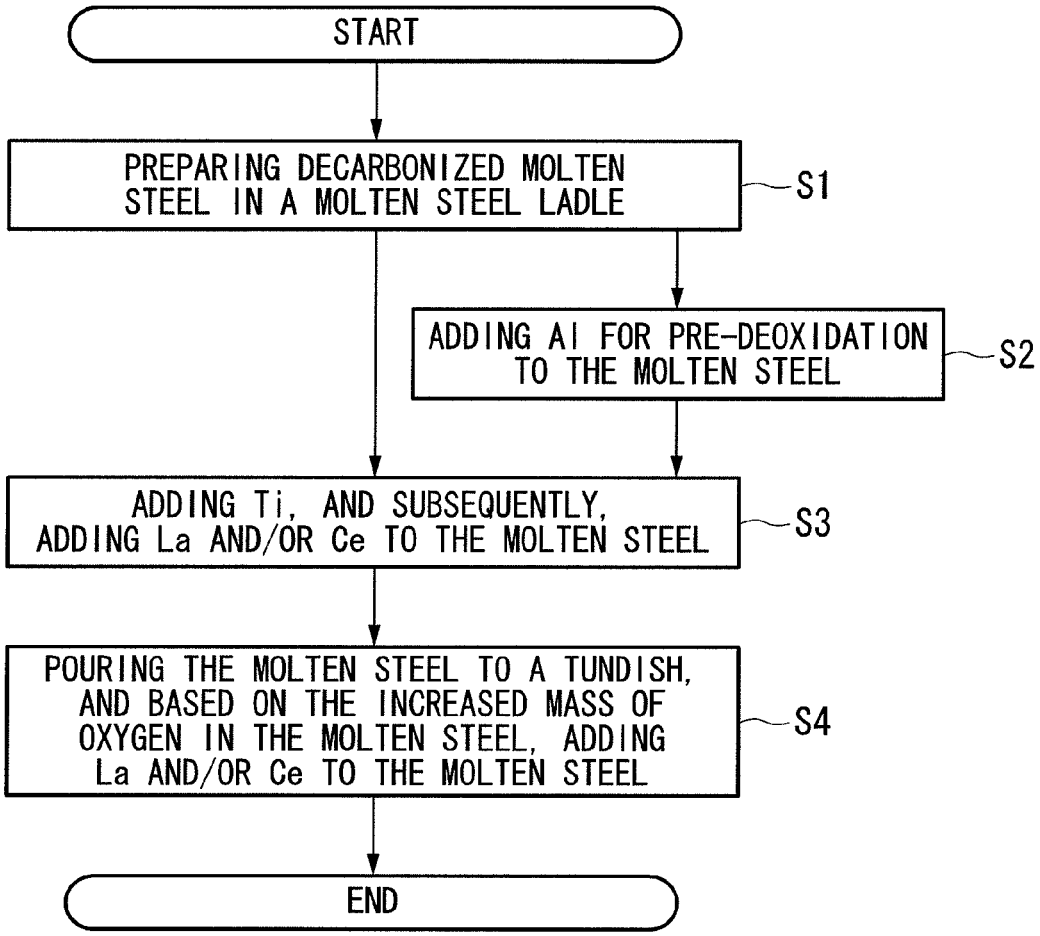
START
PREPARING DECARBONIZED MOLTEN STEEL IN A MOLTEN STEEL LADLE
S1
ADDING Al FOR PRE-DEOXIDATION TO THE MOLTEN STEEL
S2
ADDING Ti, AND SUBSEQUENTLY, ADDING La AND/OR Ce TO THE MOLTEN STEEL
S3
POURING THE MOLTEN STEEL TO A TUNDISH, AND BASED ON THE INCREASED MASS OF OXYGEN IN THE MOLTEN STEEL, ADDING La AND/OR Ce TO THE MOLTEN STEEL
S4
END

LOW-CARBON STEEL SLAB PRODUCING METHOD

CROSS REFERENCE TO RELATED APPLICATIONS

This application is a Divisional of U.S. application Ser. No. 12/989,201 filed Oct. 22, 2010, now abandoned, which is a National Phase of PCT International Application No. PCT/JP2009/062795 filed Jul. 15, 2009, which claims priority under 35 U.S.C. §119(a) to Patent Application No. 2008-183740 filed in Japan on Jul. 15, 2008, which designated the United States, and on which priority is claimed under 35 U.S.C. §120, the entire contents of which are hereby incorporated by reference.

TECHNICAL FIELD

The present invention relates to a method for reliably producing low-carbon steel slabs used for manufacturing low-carbon thin steel sheets, which are excellent in workability and moldability, and which have surfaces on which defects hardly occur.

BACKGROUND ART

Molten steel refined in a converter furnace and/or in a vacuum processing container contains an excessive amount of dissolved oxygen. The excessive amount of dissolved oxygen is generally deoxidized with a strong deoxidizing element having a strong affinity for oxygen, such as Al. This Al becomes alumina after conducting such deoxidation, and then, alumina aggregates to form coarse alumina clusters having diameters of hundreds μm or more.

Thin steel sheets are used for, for example, outer panels of vehicles which are subject to severe processing. For this reason, the carbon concentration in steel for the thin steel sheet is reduced to 0.05 mass % or less for improving workability of the thin steel sheet. The reduced carbon concentration, however, leads to a high concentration of the dissolved oxygen after refining. As a result, a large amount of alumina is generated by Al deoxidation, and then, alumina clusters are generated in large amounts.

If alumina clusters are generated in large amounts, at the time of continuous casting operation in which molten steel is poured from a ladle containing the molten steel to casting molds via a tundish using immersion nozzles, the alumina clusters may be deposited on the immersion nozzle. These alumina clusters block the transfer of the molten steel, and disturb the continuous casting operation. This phenomenon is called "nozzle clogging".

Further, alumina clusters cause surface defects at the time of producing steel sheets, and severely impair qualities of the thin steel sheets. Therefore, countermeasures are required for reducing the amount of alumina causing alumina clusters.

As a countermeasure for reducing the amount of alumina, Patent Document 1 discloses a method for removing alumina by adding flux for absorbing inclusions into a molten steel surface. Further, as another countermeasure for reducing alumina, Patent Document 2 discloses a method for adsorbing and removing alumina by adding CaO flux into molten steel. With these methods, however, it is extremely difficult to sufficiently remove a large amount of alumina generated in low-carbon molten steel.

Meanwhile, as a method for suppressing generation of alumina (instead of removing alumina), there is a method for removing dissolved oxygen after a decarburizing process, by deoxidizing elements other than Al. For example, Patent Document 3 discloses a method for smelting molten steel used for thin steel sheets, and in this method, Mg is used for deoxidation. However, Mg vapor pressure is high and the yield ratio to molten steel is significantly low. For this reason, in a case that only Mg is used for deoxidizing molten steel with a high concentration of dissolved oxygen such as low-carbon steels, a large amount of Mg is required. Therefore, in view of manufacturing cost, it is not considered that the above method is practical.

Considering the above problems regarding deoxidation of molten steel using Al, Patent Document 4 discloses a method of using Ti, and La and/or Ce in combinations as deoxidizing elements. According to this method, inclusions contained in deoxidized molten steel become compound inclusions of Ti oxide, and La oxide and/or Ce oxide. Since these compound inclusions finely disperse in the molten steel rather than aggregating one another, the above-mentioned coarse alumina cluster will not be generated, that is, neither nozzle clogging nor surface defects on the steel sheet occur.

RELATED ART DOCUMENTS

Patent Documents

[Patent Document 1] Japanese Unexamined Patent Application, First Publication No. H05-104219
[Patent Document 2] Japanese Unexamined Patent Application, First Publication No. S63-149057
[Patent Document 3] Japanese Unexamined Patent Application, First Publication No. H05-302112
[Patent Document 4] PCT publication No. WO 03/002771 A1

DISCLOSURE OF THE INVENTION

Problems that the Invention is to Solve

However, even in the method disclosed in Patent Document 4, molten steel may be subject to oxidation by ambient oxygen or slag in a tundish at the time of pouring the molten steel from a ladle containing the molten steel to the tundish.

More specifically, in the case that Ti, and La and/or Ce are used as deoxidizing elements for oxidizing molten steel, Ti in the molten steel is preferentially oxidized and then, the content rate of Ti oxide in the inclusions will increase. As a result, composition of the inclusion changes from the above-described composition in which aggregation hardly occurs, to a composition in which aggregation frequently occurs, thereby causing nozzle clogging or surface defects on the steel sheet.

An object of the present invention is to provide a low-carbon steel slab producing method that can prevent nozzle clogging and surface defects on a steel sheet which are caused by aggregated inclusions, by using Ti, and La and/or Ce as deoxidizing elements for molten steel, controlling composition change of the inclusions in the molten steel due to oxidation of the molten steel in a tundish, and preventing inclusions from aggregating.

Means for Solving the Problems

In order to solve the above-described problems, the present invention employs the following.

(1) A low-carbon steel slab producing method according to an invention including: adding Ti to a molten steel decarbonized to have a carbon concentration of 0.05 mass % or less, and subsequently adding at least one of La and Ce to adjust a composition, and producing a smelted molten steel used for a low-carbon steel slab containing, by mass %, more than 0% and equal to or less than 0.05% of carbon, more than 0% and equal to or less than 0.01% of Si, more than 0% and equal to or less than 0.5% of Mn, more than 0% and equal to or less than 0.05% of P, more than 0% and equal to or less than 0.02% of S, more than 0% and equal to or less than 0.01% of Al, more than 0.01% and equal to or less than 0.4% of Ti, and in combination, 0.001% or more and 0.01% or less of at least one of La and Ce, and 0.004% or more and 0.02% or less of oxygen, and iron as a base component; and pouring the smelted molten steel into a casting mold via a tundish, wherein at least one of La and Ce in a total amount of 0.2 to 1.2 times an increased amount of oxygen in the smelted molten steel during the time the smelted molten steel was contained in the tundish is added to the smelted molten steel in the tundish, so as to obtain a steel slab having inclusions which contain oxides of Ti and at least one of La and Ce as chief components, and so as to make a composition of each of the inclusions have a mass ratio of 0.1 to 0.7, in terms of $(La_2O_3+Ce_2O_3)\div TiO_n$ (n=1~2).

Effects of the Invention

According to the present invention in (1), the composition of inclusions in molten steel to be subject to oxidation in a tundish can be controlled within an appropriate range. Therefore, it is possible to produce low-carbon steel slabs excellent in workability and moldability while reliably preventing nozzle clogging and product surface defects.

BRIEF DESCRIPTION OF A DRAWING

FIG. 1 is a flowchart illustrating processes for producing low-carbon steel according to an embodiment of the present invention.

EMBODIMENT OF THE INVENTION

Hereinafter, an embodiment of the present invention will be described in detail.

Firstly, the composition range of deoxidized molten steel and the composition range of inclusions contained in the deoxidized molten steel according to the embodiment of the present invention will be explained together with the reasons therefor.

The present inventors experimentally evaluated aggregating action of inclusions, by using, as deoxidizers to be added to molten steels, Al, Ti, La and Ce in appropriate combinations thereof. Analysis was made on inclusions in the molten steel, by cooling samples of the molten steel and studying the inclusions in the steel using SEM-EDX.

As a result, it was confirmed that $Al_2O_3$ inclusions, $TiO_n$ inclusions (n=1~2, the same applies to hereinafter), $Al_2O_3$—$La_2O_3$—$Ce_2O_3$ compound inclusions, $Al_2O_3$—$La_2O_3$ compound inclusions, and $Al_2O_3$—$Ce_2O_3$ compound inclusions were aggregated with relative ease. It was further confirmed that, on the contrary, $TiO_n$—$La_2O_3$—$Ce_2O_3$ compound inclusions, $TiO_n$—$La_2O_3$ compound inclusions, and $TiO_n$—$Ce_2O_3$ compound inclusions were not aggregated but dispersed in the molten steel as fine inclusions in spherical shapes or in spindle shapes.

A reason of the above phenomenon may be suggested that $TiO_n$—$La_2O_3$—$Ce_2O_3$, $TiO_n$—$La_2O_3$, and $TiO_n$—$Ce_2O_3$ have smaller interface energy between inclusions and molten steel than that of $Al_2O_3$, $TiO_n$, $Al_2O_3$—$La_2O_3$—$Ce_2O_3$, $Al_2O_3$—$La_2O_3$, and $Al_2O_3$—$Ce_2O_3$. That is, if the interface energy is small, inclusions may be reliably presented in molten steel, and aggregation of the inclusions may be suppressed.

Further, it was confirmed from experiments that aggregation of the inclusions depended on the mass ratio of $La_2O_3$+$Ce_2O_3$ and $TiO_n$. More specifically, for suppressing aggregation of the inclusions in molten steel, if the value regarding the mass ratio of $La_2O_3$+$Ce_2O_3$ and $TiO_n$ contained in the inclusions obtained from the equation $(La_2O_3+Ce_2O_3)\div TiO_n$ (hereinafter, this value may be described as "modification index") is 0.1 or more, the interface energy between the inclusions and the molten steel decreases. That is, aggregation of the inclusions can be suppressed. It should be noted that the modification index is preferably 0.15 or more, and more preferably, 0.2 or more.

Meanwhile, if the modification index exceeds 0.7, the melting point of the inclusions will decrease and the inclusions will enter a liquid state in molten steel. Therefore, inclusions rather frequently aggregate and form coarse inclusions. For this reason, the modification index should be 0.7 or less. The modification index is preferably 0.6 or less, and more preferably 0.5 or less.

In the case of carrying out pre-deoxidation with Al (as described later), inclusions may contain not only Ti, and La and/or Ce, but also Al. As a result of studying this fact, it was confirmed from experiments that if the amount of Al oxides in the inclusions does not reach 25 mass %, the effect of suppressing aggregation of the inclusions was not disturbed.

Accordingly, in the present invention, with respect to each of the inclusions contained in deoxidized molten steel, oxidation products of Ti, and La and/or Ce are generated as chief components.

In the case of not carrying out pre-deoxidation with Al, the total amount of oxides of Ti, and La and/or Ce in each inclusion reaches almost 100 mass %. However, even if the pre-deoxidation with Al is carried out and Al oxides are contained in the inclusions, it is still possible to regard oxidation products of Ti, and La and/or Ce as chief components.

Here, as a criterion regarding the chief components, a state in which inclusions contain 75 mass % or more of oxidation products of Ti, and La and/or Ce in total may be proposed. In this state, as same to the case that the total amount of the oxidation products of Ti, and La and/or Ce does not reach about 100 mass %, the aggregation of the inclusions may be suppressed.

Since all of Ti, La, and Ce are deoxidizing elements, oxygen concentration in molten steel is decreased by adding these elements. Upon decreasing the oxygen concentration, the surface tension of the molten steel increases. If the surface tension of the molten steel increases too much, even if the modification index of the inclusion is controlled to be fallen within the above-described range, it is impossible to sufficiently reduce the interface energy between the molten steel and the inclusions. As a result, the inclusions aggregate and form coarse inclusions.

Meanwhile, if the oxygen concentration in the molten steel increases too much, a large amount of inclusions are generated due to deoxidation. Then, the collision probability of the inclusions increases, thereby promoting aggregations.

Therefore, it was discovered that the oxygen concentration has an appropriate range defined by the upper limit and the lower limit for sufficiently preventing inclusions from coarsening, and in order for the oxygen concentration to fall within the appropriate range, there is an appropriate range for the amount of deoxidizing elements. More specifically, as a result of experimentally studying, it was discovered that the aggregation of the inclusions may be sufficiently suppressed if the oxygen concentration of the molten steel lies in a range of 0.004 mass % or more and 0.02 mass % or less.

Basically, in the present invention, Ti is added and subsequently, one or more of La and Ce is added. Thus, Ti is mostly worked as an element for deoxidation, and one or more of La and Ce is mostly worked as elements for modifying the composition of the inclusions. Therefore, Ti may be considered as a chief element for deoxidation. That is, in order to fall the value of the oxygen concentration in the molten steel within the above-mentioned range of 0.004 mass % or more and 0.02 mass % or less, the Ti amount in the steel should be fallen within the range of 0.01 mass % or more and 0.4 mass % or less, considering deoxidation equilibria.

Furthermore, in order to fall the modification index of the inclusions within the above-mentioned appropriate range, the total amount of La and Ce in the steel should fall within the range of 0.001 mass % or more and 0.01 mass % or less, which is lower than the amount of Ti in the steel.

Next, the reason of the limitation regarding compositions in the present invention will be explained below.

[C], [Si], [Mn], [P]

Elements of C, Si, Mn, and P improve the strength and the hardness of steel sheets. Therefore, in order to improve the workability and the moldability of product sheets, the upper limits of these elements are respectively set to 0.05 mass %, 0.01 mass %, 0.5 mass %, or 0.05 mass %. Meanwhile, the lower limits of them are set to more than 0 mass %.

[S]

An element S becomes sulfide such like MnS, and is expanded by rolling process. The expanded sulfide becomes a starting point of fracture at the time of processing the product sheet, and thus deteriorates the workability. The practical upper limit is set to 0.02 mass %. Since the lower amount is preferable, the lower limit includes 0 mass %.

[Al]

An element Al, which is a strong deoxidizing element, is added to adjust the amount of [oxygen] in molten steel. However, if the Al is added excessively, a large amount of alumina will be generated in the molten steel to form alumina cluster. Then, this alumina cluster may cause nozzle clogging at the time of casting operation and generate surface defects on the product sheet. The practical upper limit at the time of carrying out pre-deoxidation with Al is set to 0.01 mass %. Since Al is not added in the case of not carrying out the pre-deoxidation, the lower limit includes 0 mass %.

[Ti], [La], [Ce], [O]

The limitations of the ranges regarding elements of Ti, La, Ce, and O, and the reasons thereof are explained above.

Next, a molten steel deoxidation process, a composition change of the inclusion due to oxidation, and a method for controlling the modification will be explained below.

In order to improve workability and moldability of the products, molten steel in which the amount of elements other than Fe are adjusted to: C, 0.05 mass % or less, Si: 0.01 mass % or less, Mn: 0.5 mass % or less, P: 0.05 mass % or less, S: 0.02 mass % or less, is decarbonized in a converter furnace and/or a vacuum processing container.

The dissolved oxygen contained in the molten steel is usually deoxidized by, mainly, adding Al. As a result, a large amount of alumina is generated, and alumina aggregates to form coarse alumina clusters having a diameter of hundreds μm or more. Then, alumina clusters may cause nozzle clogging or surface defects on the steel sheet at the time of a continuous casting operation.

Then, in the present invention, dissolved oxygen after decarburization is deoxidized by, mainly, deoxidizers other than Al so as to prevent generation of alumina clusters in large amounts. More specifically, molten steel is refined in a steel furnace such as a converter furnace or an electric furnace, and is subject to a vacuum degassing and the like, thereby reducing the carbon concentration in the molten steel to 0.05 mass % or less. To this molten steel, Ti+La, Ti+Ce, or Ti+La+Ce are added, and before a tundish stage, compound inclusions of Ti oxide, and La oxide and/or Ce oxide are generated in the molten steel.

If the deoxidation is carried out only with Ti, a large amount of Ti is required. Thus, for adjusting the amount of the dissolved oxygen before adding Ti, pre-deoxidation with a small amount of Al may also be carried out. In this case, 1-10 minute(s) should be allowed after the small amount of Al is added, for floating alumina.

Then, for carrying out continuous casting operation, molten steel contained in a ladle is poured from the ladle into casting molds via a tundish, using immersion nozzles. At this time, generally, in order to prevent the molten steel in the tundish from being exposed to air and oxidized in the tundish, the atmosphere in the tundish may be changed to an inert gas such as Ar, and a molten steel surface may be sealed by a molten flux.

However, industrially, it is difficult and substantially impossible to completely change the atmosphere in the tundish to oxygen-free atmosphere. Further, molten steel may be oxidized by slag mixed into the molten steel from the ladle. Therefore, the oxidation of the molten steel during the time the smelted molten steel was contained in the tundish inevitably occurs to some extent.

In particular, when the casting speed decreases, for example at the time of replacing the ladle, flow volume of the molten steel via a tundish decreases. Therefore, the residence time of the molten steel during the time the smelted molten steel was contained in the tundish is increased, that is, the molten steel is exposed to the atmosphere and slag for a long time. Therefore, the oxidation is likely to occur. Hereinafter, oxidation of molten steel during the time the smelted molten steel was contained in a tundish by the atmosphere or slag is described as "reoxidation".

The amount of reoxidation of the molten steel during the time the smelted molten steel was contained in the tundish is precisely defined by the difference between the amount of oxygen contained in molten steel which exists at a molten steel inlet located in an up stream of the tundish, and the amount of oxygen contained in molten steel which exists at a molten steel outlet located in an downstream of the tundish. However, considering the design of the equipment, it is difficult to measure the amount of oxygen contained in the molten steel at the molten steel inlet or molten steel outlet of the tundish. Therefore, molten steel in the ladle which contains substantially the same amount of the oxygen to that of upstream of the tundish, and molten steel in the vicinity of tundish outlet which contains substantially the same amount of oxygen to that of downstream of the tundish may be used as practical measuring points and the measured values at these measuring points may be used for the evaluation.

The amount of Ti contained in the molten steel which has Ti as chief deoxidizing element is larger than the amount of La and/or Ce. Thus, Ti is preferentially oxidized by the reoxidation of the molten steel, and Ti oxide is generated substantially in proportion to the amount of the reoxidation.

Ti oxide which is newly generated by significant reoxidation becomes $TiO_2$. This $TiO_2$ has a strong aggregation property, therefore, the $TiO_2$ and the compound inclusions of Ti oxide, and La oxide and/or Ce oxide which are already presented in the molten steel before a ladle stage are aggregated. As a result, the modification index of the compound inclusions will be decreased.

This phenomenon is notable when the casting speed decreases, for example at the time of replacing the ladle as mentioned above. For this reason, it was recognized as difficult to reliably prevent nozzle clogging or surface defects of the steel sheet caused by the aggregated inclusions, in a long-running casting operation.

The present inventor, in view of these circumstances, discovered that the deterioration of the modification index can be suppressed by adding an appropriate amount of La and/or Ce to a tundish containing molten steel in which the modification index of the inclusions has been decreased by the reoxidation occurred in the tundish, for reducing Ti oxide in the molten steel by La and/or Ce, and decreasing the amount of $TiO_n$ in the compound inclusions of Ti oxide, and La oxide and/or Ce oxide. Hereinafter, the details will be described.

La and Ce have strong deoxidation ability in comparison with that of Ti. Therefore, $TiO_2$ just after being generated by reoxidation may be reduced only by a small amount of La or Ce. Here, if $TiO_2$ is partially reduced to modify fine compound oxides having a diameter of 0.5 μm-30 μm such as $TiO_2$—$La_2O_3$, $TiO_2$—$Ce_2O_3$, $TiO_2$—$La_2O_3$—$Ce_2O_3$, and the modification index after the modification falls within the above-mentioned appropriate range, aggregation of the inclusions generated by the reoxidation may be prevented. Then, the inclusions may be modified to compound oxides in spherical shapes or spindle shapes.

For the deoxidation, one or more of La and Ce should be added to the molten steel in an amount required for the modification, in accordance with the amount of $TiO_2$ generated by the reoxidation.

The amount of $TiO_2$, which is generated by the reoxidation, is determined based on the increased mass of the oxygen in the molten steel during the time the smelted molten steel was contained in the tundish. Accordingly, using the increased mass of the oxygen in the molten steel during the time the smelted molten steel was contained in the tundish as a management index, one or more of La and Ce may be added to the molten steel in an amount required for the modification, based on the management index.

Here, the increased mass of the oxygen in the molten steel during the time the smelted molten steel was contained in the tundish may be calculated by multiplying the amount of molten steel supplied to the tundish (that is, poured amount of the molten steel to the tundish per unit of time) by the amount of reoxidation of the molten steel (that is, the oxygen concentration increased in the tundish per unit of molten steel amount). The amount of the reoxidation of the molten steel can be obtained by using zirconia oxygen sensors at the above-mentioned measuring points for measuring the value of the oxygen in the molten steel, and calculating the difference between the measured values upstream of the tundish and downstream of the tundish.

It should be noted that the increased mass of the oxygen in the molten steel during the time the smelted molten steel was contained in the tundish may vary when the ladle is replaced (that is, for each of charges). Further, even in the same charge, the increased mass of the oxygen in the molten steel during the time the smelted molten steel was contained in the tundish may vary according to the change of the operating conditions. Therefore, it is preferable to measure, using the zirconia oxygen sensor and the like, the amount of oxygen in the molten steel during the time the smelted molten steel was contained in the tundish for each of the charges, or every time the operating condition changes in order to grasp the increased mass of the oxygen in the molten steel during the time the smelted molten steel was contained in the tundish.

In order for the modification index to fall within the above-described appropriate range (i.e., 0.1 or more and 0.7 or less) by adding one or more of La and Ce in the tundish so as to partly reduce $TiO_2$ generated by the reoxidation for modifying them to compound oxides such as $TiO_2$—$La_2O_3$, $TiO_2$—$Ce_2O_3$, and $TiO_2$—$La_2O_3$—$Ce_2O_3$, to the molten steel, it is necessary to add to the molten steel, one or more of La and Ce in an amount with a mass equal to 0.2 to 1.2 times the increased mass of the oxygen in the molten steel during the time the smelted molten steel was contained in the tundish, based on the calculation using the molecular weight ratio with respect to before and after of the modification.

One or more of La and Ce is preferably added in an amount with a mass equal to 0.3 to 1.1 times the mass of the increased oxygen, and more preferably, 0.4 to 0.9 times the mass of the increased oxygen, in order for the modification index to fall within the above-described range.

One or more of La and Ce may be added by using a pure metal of one or more of La and Ce, but for example, alloyed metal including one or more of La and Ce such as mish metal may be used as well. If the total concentration of the La and Ce in the alloyed metal is more than 30 mass % or more, the effects of the present invention will not be lost even if other impurities are mixed in the molten steel at the time of adding one or more of La and Ce.

However, it should be noted that it is important to adjust the amount of alloyed metal added according to the concentration of La and/or Ce, so that the amount of La and/or Ce added falls within an appropriate range. Further, as a method of adding them, the metal may be directly added to the molten steel, but taking the loss due to slag into account, it is preferable to continuously supply the metal in a wire form coated with an iron tube.

Further, the present invention may also be employed for an ingot casting operation and a continuous casting operation. As for the continuous casting operation, the present invention may be employed not only for a continuous casting operation for producing normal slabs in the thickness of about 250 mm, but also for a continuous casting operation which uses a casting machine having thinner casting molds for producing thin slabs of a thickness of 150 mm or less, and sufficient effects may be derived. Then, nozzle clogging can be reliably prevented. The steel slabs obtained by the above-described method may be used for producing steel sheets using a hot rolling process and/or a cold rolling process.

EXAMPLES

Hereinbelow, examples regarding the present invention and comparative examples will be described with reference to a flowchart in FIG. 1.

Example 1

300 tons of molten steel containing 0.0013 mass % of C, 0.004 mass % of Si, 0.25 mass % of Mn, 0.009 mass % of P, and 0.006 mass % of S was produced through refining in a converter furnace and process in an RH degasser, and was prepared in a ladle (S1 in FIG. 1). After adding Ti to the molten steel, La and Ce were added thereto (S3 in FIG. 1). Then, molten steel containing 0.053 mass % of Ti, 0.0007 mass % of La, 0.0005 mass % of Ce, and 0.0046 mass % of oxygen was obtained.

The molten steel in the ladle was taken as a sample for studying inclusions. Then, it was found that there existed inclusions in spherical shape or spindle shape having a diameter of 0.5 μm-30 μm. Further, all of the inclusions were oxides consisting of $TiO_2$, $La_2O_3$, and $Ce_2O_3$, and the modification indexes of these inclusions fall within a range of 0.16 or more and 0.58 or less.

From the ladle, the molten steel in the amount of 4.4 tons per a minute was poured into casting molds via a tundish, using immersion nozzles. At the time of pouring, the oxygen concentration of molten steel at a downstream of the tundish (in the vicinity of tundish outlet) was measured with a zirconia oxygen sensor, and it was found that the oxygen concentration was 0.0088 mass %, that is, the increased oxygen concentration in the tundish was 0.0042 mass %.

Then, alloyed metal containing 50 mass % of La and 50 mass % of Ce in a wire form coated with a steel pipe was added into the tundish in the amount of 40 g/minute, 80 g/minutes, or 200 g/minutes, so that the adding amount of La+Ce to the molten steel becomes 0.22 times, 0.43 times, or 1.08 times the increased mass of the oxygen contained in the molten steel in the tundish (that is, a value obtained by multiplying 4.4 tons/minute which is the amount of molten steel poured into the tundish in a unit time, by 0.0042 mass % which is the concentration of increased oxygen in the tundish in a unit amount of the molten steel) (S4 in FIG. 1).

Employing a continuous casting method, this molten steel was cast at a casting speed of 1.4 m/min for producing slabs having a thickness of 250 mm and a width of 1800 mm. At the time of casting, clogging was not occurred in the immersion nozzle.

The casted slabs were cut to 8500 mm in length, as a coil unit. Analysis was made on inclusions in an area up to 20 mm in depth from a surface of the slab. As a result, it was found that in any of slabs to which alloyed metal in the amount of 40 g, 80 g, or 200 g per minute was added, there existed oxide inclusions consisting of $TiO_2$, $La_2O_3$, and $Ce_2O_3$ in spherical shape or spindle shape each having a diameter of 0.5 μm-30 μm. The modification indexes of these inclusions fell within a range of 0.15 or more and 0.55 or less.

The slabs thus obtained were hot rolled and subsequently cold rolled, in a usual manner. Then, coils of cold-rolled steel sheets each having a thickness of 0.7 mm and a width of 1800 mm were obtained. Qualities of the steel sheet surfaces were visually observed in an inspection line after the cold rolling, for evaluating the number of occurrences of surface defects per coil. As a result, it was found that no surface defect was generated.

Example 2

300 tons of molten steels respectively containing 0.0013 mass % of C, 0.004 mass % of Si, 0.25 mass % of Mn, 0.009 mass % of P, 0.006 mass % of S were produced through refining in a converter furnace and process in an RH degasser, and were respectively prepared in a first ladle and a second ladle (S1 in FIG. 1). Then, to each of the ladles containing the molten steel, 100 kg of Al for pre-deoxidation was added and refluxed for three minutes, thereby obtaining molten steel containing 0.002 mass % of Al and 0.012 mass % of oxygen (S2 in FIG. 1).

Further, to each of the molten steels, 200 kg of Ti was added and refluxed for one minute, and subsequently, 40 kg of Ce was added to the first ladle, and 40 kg of La was added to the second ladle (S3 in FIG. 1). Then, molten steels containing 0.033 mass % of Ti and 0.01 mass % of oxygen, which further contain La or Ce in the concentration of 0.005 mass % were obtained.

Each of the molten steels in the ladles was taken as a sample for studying inclusions. Then, it was found that there existed inclusions in spherical shape or spindle shape having a diameter of 0.5 μm-30 μm. Further, all of the inclusions were oxides including 10 mass % or less of $Al_2O_3$ and the balance consisted of $TiO_2$ and $La_2O_3$ or $Ce_2O_3$. The modification indexes of these inclusions fell within a range of 0.22 or more and 0.48 or less.

From the ladle, the molten steel in the amount of 4.4 tons per a minute was poured into casting molds via a tundish, using immersion nozzles. At the time of pouring, the oxygen concentration of molten steel at a downstream of the tundish (in the vicinity of the tundish outlet) was measured with a zirconia oxygen sensor, and it was found that the oxygen concentration was 0.02 mass %, that is, the increased oxygen concentration in the tundish was 0.01 mass %.

Then, alloyed metal containing La was added into the tundish in the amount of 110 g/minute or 485 g/minutes, so that the adding amount of La to the molten steel in the first ladle becomes 0.25 times or 1.1 times the increased mass of oxygen in the molten steel during the time the smelted molten steel was contained in the tundish (that is, a value obtained by multiplying 4.4 tons/minute which is the amount of molten steel poured into the tundish in a unit time, by 0.01 mass % which is the concentration of oxygen increased in the tundish in a unit amount of the molten steel) (S4 in FIG. 1).

Further, alloyed metal containing Ce was added into the tundish in the amount of 220 g/minute, so that the adding amount of Ce to the molten steel in the second ladle becomes 0.5 times the amount of the increased mass of oxygen, in the same manner (S4 in FIG. 1). Employing a continuous casting method, these molten steels were cast at the casting speed of 1.4 m/min for producing slabs having a thickness of 250 mm and a width of 1800 mm. At the time of casting, clogging had not occurred in the immersion nozzle.

These slabs thus produced were hot rolled and subsequently cold rolled, in a usual manner. Then, coils of cold-rolled steel sheets having a thickness of 0.7 mm and a width of 1800 mm were obtained. Qualities of the steel sheet surfaces were visually observed in an inspection line after the cold rolling, for evaluating the number of occurrences of surface defects per coil. As a result, it was found that no surface defects were generated.

Further, analysis was made on inclusions in the cold rolled steel sheet. As a result, it was found that in any case of adding La or Ce, there existed oxide inclusions in a spherical shape or a spindle shape including 10 mass % or less of $Al_2O_3$ and the balance consisting of $TiO_2$, and $La_2O_3$, or $TiO_2$ and $Ce_2O_3$ in spherical shapes or in spindle shapes having diameter of 0.5 μm-30 μm. The modification indexes of these inclusions fell within a range of 0.2 or more and 0.45 or less.

Comparative Example 1

300 tons of molten steel containing 0.0013 mass % of C, 0.004 mass % of Si, 0.25 mass % of Mn, 0.009 mass % of P, and 0.006 mass % of S was produced through refinement in a converter furnace and process in an RH degasser, and was prepared in a ladle. After adding Ti to the molten steel, La and Ce were added thereto. Then, molten steel containing 0.037 mass % of Ti, 0.001 mass % of La, 0.0008 mass % of Ce, and 0.008 mass % of oxygen was obtained.

The molten steel in the ladle was taken as a sample for studying inclusions. Then, it was found that there existed inclusions in spherical shape or spindle shape each having a diameter of 0.5 μm-0.30 μm. Further, all of the inclusions were oxides consisted of $TiO_2$, $La_2O_3$, and $Ce_2O_3$, and the modification indexes of these inclusions fell within a range of 0.12 or more and 0.33 or less.

From the ladle, the molten steel in the amount of 4.4 tons per a minute was poured into casting molds via a tundish, using immersion nozzles. At the time of pouring, the oxygen concentration of molten steel at a downstream of the tundish (in the vicinity of tundish outlet) was measured with a zirconia oxygen sensor, and it was found that the oxygen concentration was 0.0165 mass %, that is, the increased oxygen concentration in the tundish was 0.0085 mass %.

Employing a continuous casting method, this molten steel was cast at a casting speed of 1.4 m/min for producing slabs having a thickness of 250 mm and a width of 1800 mm. At the time of casting, clogging occurred in the immersion nozzle, and thus, casting was forced to be terminated and 100 tons of the molten steel was remaining in the ladle.

The casted slabs were cut to 8500 mm in length, as a coil unit. Analysis was made on inclusions in an area up to 20 mm in depth from a surface of the slab. As a result, it was found that there existed oxide inclusions consisting of $TiO_2$, $La_2O_3$, and $Ce_2O_3$ in a spherical shape or in a spindle shape having a diameter of 0.5 μm-30 μm in a state of aggregated cluster having more than 150 μm were aggregated. The modification indexes of these inclusions fell within a range of 0.05 or more and 0.1 or less.

The slabs thus obtained were hot rolled and subsequently cold rolled, in a usual manner. Then, coils of cold-rolled steel sheets having a thickness of 0.7 mm and a width of 1800 mm were obtained. Qualities of the steel sheet surfaces were visually observed in an inspection line after the cold rolling, for evaluating the number of occurrences of surface defects per coil. As a result, it was found that 5 surface defects per coil were generated.

Comparative Example 2

300 tons of molten steels respectively containing 0.0013 mass % of C, 0.004 mass % of Si, 0.25 mass % of Mn, 0.009 mass % of P, and 0.006 mass % of S were produced through refinement in a converter furnace and process in an RH degasser, and were respectively prepared in a first ladle and in a second ladle. Then, to each of the ladles containing the molten steel, 100 kg of Al for pre-deoxidation was added and refluxed for three minutes, thereby obtaining molten steel containing 0.002 mass % of Al and 0.013 mass % of oxygen.

Further, to each of the molten steels, 200 kg of Ti was added and refluxed for one minute, and subsequently, 40 kg of Ce was added to the first ladle, and 40 kg of La was added to the second ladle. Then, molten steels containing 0.033 mass % of Ti and 0.01 mass % of oxygen, which further contain La or Ce in the concentration of 0.005 mass % were obtained.

Each of the molten steels in the ladles was taken as a sample for studying inclusions. Then, it was found that there existed inclusions in spherical shapes or spindle shapes having a diameter of 0.5 μm-30 μm. Further, all of the inclusions were oxides including 10 mass % or less of $Al_2O_3$ and the balance consisting of $TiO_2$+$La_2O_3$, or $TiO_2$+$Ce_2O_3$. The modification indexes of these inclusions fell within a range of 0.22 or more and 0.48 or less.

From the ladle, the molten steel in the amount of 4.4 tons per a minute was poured into casting molds via a tundish, using immersion nozzles. At the time of pouring, the oxygen concentration of molten steel at a downstream of the tundish (in the vicinity of tundish outlet) was measured with a zirconia oxygen sensor, and it was found that the oxygen concentration was 0.02 mass %, that is, the increased oxygen concentration in the tundish was 0.01 mass %.

Then, alloyed metal containing La was added into the tundish in the amount of 65 g/minute so that the amount of La added to the molten steel in the first ladle becomes 0.15 times the increased mass of oxygen in the molten steel during the time the smelted molten steel was contained in the tundish (that is, a value obtained by multiplying 4.4 tons/minute which is the amount of molten steel poured into the tundish in a unit time, by 0.01 mass % which is the concentration of oxygen increased in the tundish in a unit amount of the molten steel). Further, alloyed metal containing Ce was added into the tundish in the amount of 600 g/minute, so that the adding amount of Ce to the molten steel in the second ladle becomes 1.36 times the increased mass of oxygen, in the same manner.

Employing a continuous casting method, these molten steels were cast at the casting speed of 1.4 m/min for producing slabs having a thickness of 250 mm and a width of 1800 mm. At the time of casting, clogging was occurring in the immersion nozzle, and thus, casting was forced to be terminated and 50 tons of the molten steel were remaining in the ladle.

The slabs thus obtained were hot rolled and then cold rolled in a usual manner. Then, coils of cold-rolled steel sheets having a thickness of 0.7 mm and a width of 1800 mm were obtained. Qualities of the steel sheet surfaces were visually observed in an inspection line after the cold rolling, for evaluating the number of occurrences of surface defects per a coil. As a result, it was found that, as an average of slabs, 5 defects were generated in the La added coil and 10 defects were generated in the Ce added coil.

Further, analysis was made on inclusions in the cold rolled steel sheet. As a result, it was found that in the La added coil, there existed oxide inclusions including 10 mass % or less of $Al_2O_3$ and the balance consisting of $TiO_2$ and $La_2O_3$ in spherical shapes or spindle shapes having a diameter of 0.5 μm-30 μm, in a state of aggregated clusters having a size of 150 μm. These modification indexes of these inclusions fell within a range of 0.05 or more and 0.1 or less.

It was also found that in the Ce added coil, there existed expanded oxide inclusions including 10 mass % or less of $Al_2O_3$ and the balance consisting of $TiO_2$ and $Ce_2O_3$, having a diameter of 1000 μm or longer. The modification indexes of these inclusions fell within a range of 0.75 or more and 1.0 or less.

INDUSTRIAL APPLICABILITY

From the foregoing, according to the present invention, it is possible to control the composition of the inclusions in the molten steel which was reoxidized in the tundish within an appropriate range. Therefore, nozzle clogging or product surface defects can be reliably prevented and it is possible to reliably produce low-carbon thin steel sheets in a long running casting operation. Therefore, the present invention has excellent industrial applicability in a steel manufacturing industry.

The invention claimed is:

1. A low-carbon steel slab producing method, comprising:

adding Ti without carrying out Al pre-deoxidation to a decarbonized molten steel having a carbon concentration of 0.0013 mass % or less;

subsequently adding at least one of La and Ce to adjust a composition;

producing a smelted molten steel, used for a low-carbon steel slab, containing, by mass %, more than 0% and equal to or less than 0.0013% of carbon, more than 0% and equal to or less than 0.01% of Si, more than 0% and equal to or less than 0.5% Mn, more than 0% and equal to or less than 0.05% P, equal to or more than 0% and equal to or less than 0.02% of S, 0.01% or more and equal to or less than 0.4% of Ti, and in combination, 0.001% or more and 0.01% or less of at least one of La and Ce, and 0.004% or more and 0.02% or less of oxygen, and iron as a base component;

pouring the smelted molten steel into a casting mold via a tundish, wherein after producing smelted molten steel having inclusions which contain oxides of Ti and at least one of La and Ce as chief components, measuring the oxygen concentration of the molten steel at a downstream of the tundish with an oxygen sensor and determining an increased amount of oxygen in the smelted molten steel picked up during the time the smelted molten steel was contained in the tundish, and continuously adding at least one of La and Ce to the smelted molten steel in the tundish, in wire form, in a total amount of 0.2 to 1.2 times the determined increased amount of oxygen, so as to obtain a steel slab having inclusions which contain oxides of Ti and at least one of La and Ce as chief components with a mass ratio of 0.1 to 0.7, in terms of $(La_2O_3+Ce_2O_3)/TiO_n$ (n=1 to 2).

* * * * *